United States Patent [19]

Ernst et al.

[11] Patent Number: 4,541,968

[45] Date of Patent: Sep. 17, 1985

[54] COOLING TOWER

[75] Inventors: Günter Ernst; Edmund Baer, both of Karlsruhe; Dieter Wurz, Pfinztal; Hans Dittrich; Wilhelm Roller, both of Karlsruhe, all of Fed. Rep. of Germany

[73] Assignee: Günter Ernst, Fed. Rep. of Germany

[21] Appl. No.: 147,264

[22] Filed: May 5, 1980

Related U.S. Application Data

[60] Continuation-in-part of Ser. No. 932,431, Aug. 10, 1978, abandoned, which is a continuation of Ser. No. 756,982, Jan. 5, 1977, abandoned, which is a continuation of Ser. No. 557,350, Mar. 11, 1975, abandoned, and Ser. No. 147,264, May 5, 1980, abandoned, which is a continuation-in-part of Ser. No. 971,895, Dec. 21, 1978, abandoned, which is a continuation of Ser. No. 832,688, Sep. 12, 1977, abandoned, which is a division of Ser. No. 756,982.

[30] Foreign Application Priority Data

Mar. 23, 1974 [DE] Fed. Rep. of Germany ..... 2414172

[51] Int. Cl.[4] ..... B01F 3/04

[52] U.S. Cl. ..... 261/109; 261/DIG. 11

[58] Field of Search ..... 261/94–98, 261/DIG. 11, 109, 104; 110/184; 114/187; 104/52; 98/58, 60, 70, 73, 78, 81, 83, 84

[56] References Cited

U.S. PATENT DOCUMENTS

| | | | |
|---|---|---|---|
| 3,385,197 | 5/1968 | Greber | 261/109 |
| 3,422,883 | 1/1969 | Daltry | 261/DIG. 11 |
| 3,759,496 | 9/1973 | Teller | 261/DIG. 11 |

FOREIGN PATENT DOCUMENTS

| | | | |
|---|---|---|---|
| 542261 | 12/1931 | Fed. Rep. of Germany | 261/DIG. 11 |
| 2154530 | 2/1973 | Fed. Rep. of Germany | 261/DIG. 11 |
| 1183193 | 3/1970 | United Kingdom | 261/DIG. 11 |

*Primary Examiner*—Richard L. Chiesa

*Attorney, Agent, or Firm*—L. Lawton Rogers, III

[57] ABSTRACT

A cooling tower is provided with a crown inwardly tapered towards the upper discharge opening defined by the upper rim of the crown to create a pressure differential greater on the inside than on the outside of the crown to inhibit cold air break-ins in still air or winds of low velocity. To reduce the effect of side winds of high velocity, the crown may carry a wind-deflector ring with an upwardly-inclined deflecting surface to inhibit the creation of a vortex over the tower. The tower may be suspended by cables from a central mast, and the wind-deflector ring may be suspended by separate cables from the mast, these latter cables being tensioned between the masthead and the lower part of the crown by means of a support ring arranged at the base of the wind-deflector ring.

27 Claims, 9 Drawing Figures

COOLING TOWER

RELATED APPLICATIONS

This application is a continuation-in-part of Ser. No. 932,431 filed Aug. 10, 1978, which is a continuation of Ser. No. 756,982 filed Jan. 5, 1977, which is a continuation of Ser. No. 557,350 filed Mar. 11, 1975 and Ser. No. 147,264 filed May 5, 1980 is also a continuation-in-part of Ser. No. 971,895 filed Dec. 21, 1978, which is a continuation of Ser. No. 832,688 filed Sept. 12, 1977 which is a division of Ser. No. 756,982, above identified, all abandoned.

BACKGROUND OF THE INVENTION

This invention relates to natural draught cooling towers and to a method and apparatus for preventing cold air break-ins at low wind velocities and the formation of a vortex over the tower at high wind velocities.

Natural draught cooling towers are well known. The purpose of a natural draught cooling tower is to extract the heat from the heated coolant water of a thermal power station, a manufacturing process, or the like. The coolant water gives off its heat to the ambient air which is conveyed upwardly in the cooling tower by the natural uplift of the ambient air being heated in the cooling tower.

As is well known, the cooling tower separates the relatively warmer air within the tower from the relatively cooler air outside the tower. As the heated air rises within the tower, the heavier cooler air is pulled into the tower at the lower end for warming. The tower must, of course, be closed, i.e, without apertures, to maintain the separation of the two air masses. The difference in the temperature of the two air masses is reflected in their pressure and the pressure differential between the air inside and outside of the cooling tower is a maximum at the bottom of the tower and decreases as a function of the height of the tower to the crown where the pressures are the same.

Prior to the present invention, the crown portion of cooling towers was enlarged to have effect as a diffusor and thus to increase the effectiveness of the cooling tower by a partial regeneration of pressure energy. The hyperbolic shape has become the standard. The universally adopted rule has been to avoid acceleration of the plume beyond that necessary to generate the required uplift. See, for example, the article "Gegenwärtige Kühlturmtechnik" ("Cooling Tower Techniques of Today") by Dr. Ing. Paul Berliner, Karlsruhe in the Journal "Wärme" (Heat) pp. 25–29, Vol. 80, 1974.

The phenomenon of cold air penetration downwardly into the top of the cooling tower in still air generally has not been considered a problem. However, recent studies have shown that cold ambient air in still air conditions flows into the tower to form a ring inside the crown of the cooling tower. Since the pressure inside and outside the tower is thus equalized to the extent of the cold air penetration, the crown position of the tower is not effective and the effective height of the tower is decreased. The plume is accelerated and the air flow from the tower is diminished.

These recent investigations (published in Fortschrittsberichte V.D.I.-Z., Series 15, No. 5, July, 1974) have shown that the weather conditions can substantially influence the functioning of the cooling tower. As discussed above, the known cylindrical and hyperbolic forms of cooling tower promote, in low wind velocities, the penetration of colder and therefore heavier air into the outlet opening at the top of the cooling tower. As a result, the effective height of the cooling tower can be reduced by up to 25% and more.

A second and related problem exists with high wind velocities, where the wind produces a dead region in the form of a flow vortex in the cooling tower outlet. This vortex partially obstructs the cooling tower outlet and, with a wind velocity of 20 m/s, can reduce the effective uplift height of the cooling tower as much as 30%.

The present invention has as a principal object the development of a novel cooling tower in which the effects of weather conditions on the performance of the tower are significantly reduced.

In regard to cold air penetration, one feature of the invention is to provide a cooling tower having a crown tapered inwardly towards the upper opening rim. In this connection, the term "crown" is used to mean the upper end portion of the cooling tower wall, having an axial length which is small in comparison with the total height of the tower.

The new cooling tower of the present invention is designed so that the pressure gradients in the tapered crown region of the cooling tower show the following relative behavior inside and outside the cooling tower in still air and wind velocities less than about 10 m/s:

$$\left(\frac{\partial p}{\partial z}\right)_i \geqq \left(\frac{\partial p}{\partial z}\right)_a \tag{1}$$

in which p=pressure, i=inside the tower, a=outside and z=the vertical height coordinates measured downwardly from the upper rim of the crown. In the tapered crown region, there is produced a barrier layer, which prevents the penetration of cold air, because the sum of the specific gravity of the heated plume and volume-related inertia forces is greater than the specific gravity of the cold outside air.

It is an important advantage that the tapered region, initiated with a bend or angle, stiffens the casing of the cooling tower, so that it is possible to dispense with the usual stiffening or reinforcing ring which surrounds the crown of conventional cooling towers.

As regards the design in practice, there are also to be taken into account the different temperatures, gas constants and densities of the media inside and outside the cooling tower. The tower itself must have a height of at least 80 m. to provide the necessary updraught and the interior thereof should be free of corners. The height H (axial length) of the tapered crown region is determined, in practice, to be between 3% and 10% of the total height of the cooling tower, preferably 5%. The ratio between height H of the cooling tower crown and the largest diameter D of the crown, i.e., the diameter at the lower end thereof, may be between about 1 to 12 and about 1 to 3.

One suitable height-diameter ratio H/D is in the order of magnitude of 1 to 7. With this H/D ratio, a ratio $F_2/F_1$ between the largest cross-sectional area $F_1$ at the bottom of the crown and the smallest cross-sectional area $F_2$ at the top of the crown of about 4/5 would be appropriate in order to produce the required pressure gradients for a cooling tower with D of about 40 m. The average slope angle of the tapered crown region is also fixed by the ratios H/D and $F_2/F_1$.

A particularly simple construction may be provided when the tapered crown region is conical with straight surface lines. This construction can be produced cheaply and simply, for example by a sheet metal construction. The usual concrete construction can, however, also be used. Alternatively, the crown region may have a continuously curved contour or a contour which is composed of straight sections of different slope.

The design of the cooling tower as thus far described serves mainly for the purpose of preventing cold air penetrations or break-ins at relatively low wind velocities and thus the loss in uplift which is connected therewith. This design is more particularly proposed for cooling towers with natural uplift since the flow of air from forced draught towers is generally at a velocity which would prevent such cold air penetration.

As to the mitigation of the harmful influences of a strong side wind (more than approximately 10 m/s), the cooling tower of the present invention includes a wind-deflecting means having upwardly-sloping deflector surfaces in the crown region adjacent the rim of the cooling tower.

This second feature may be provided in association with the cooling tower crown as described above. The combined use of both features is particularly useful in a natural draught cooling tower. A cooling tower embodying both of these features of the present invention can be operated with optimal efficiency in still air or relatively low wind velocities to avoid the cold air penetrations which then tend to occur, and also with a strong side wind to avoid the partial obstruction of the outlet flow which is generally connected therewith.

Under weather conditions in which cold air penetrations play a subordinate part, but in which there is frequently a high side wind, a design with the wind-guiding means but without the tapered region may be sufficient. This wind deflecting design, moreover, may also be used with cooling towers having artificially generated uplift.

A design of the cooling tower with the tapered crown region alone but without the wind deflecting means is to be preferred under weather conditions in which there is only seldom a side wind and certainly not a high one.

Further objects and advantages of the invention will be apparent from the claims and from the following more detailed explanation of the invention with reference to the several embodiments shown in the accompaning diagrammatic drawings.

DESCRIPTION OF PREFERRED EMBODIMENTS

Figure 1:
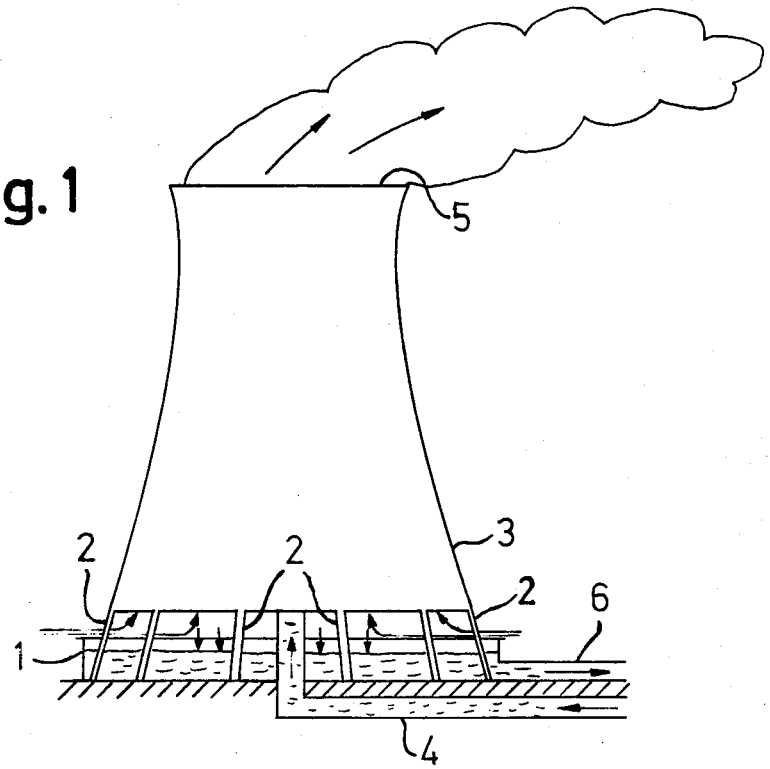
FIG. 1 is a side elevation, partially in section, of a conventional hyperbolic cooling tower.

FIG. 1 shows a conventional natural draught cooling tower, i.e., a cooling tower with naturally produced uplift. The foundation of the cooling tower is formed by a collecting tank 1 for the cooled water. Resting on the bottom of this collecting tank 1 are supports 2, which carry the cooling tower wall 3 with the trickler fillings which are not shown. The water which has become heated, for example, the water coming from a thermal power station, is supplied to these trickler units through a duct 4. The water falls from the trickler units into the collecting tank 1 and is consequently cooled by the ambient air penetrating between the supports 2. Consequently, the ambient air is heated, so that it assumes a lower density in the cooling tower and ascends in the latter. The "vapor" discharges from the opening defined by the rim 5 of the crown of the cooling tower. The cooled water is returned through the duct 6 from the collecting tank 1 to the thermal power station.

The conventional cooling tower is initially convergent in its lower part, and then widens out hyperbolically above a constricted portion to the rim 5 of the opening. Measurements undertaken by the inventors have shown that, with still air or low wind velocities, penetrations of cold air can seriously impair the discharge of the vapor and that, with higher wind velocities, the outlet opening can be at least partially obstructed, in the prevailing side wind direction, by a horizontal flow vortex being established in the outlet opening on the windward side, i.e., on the side from which the wind blows.

Figure 2:
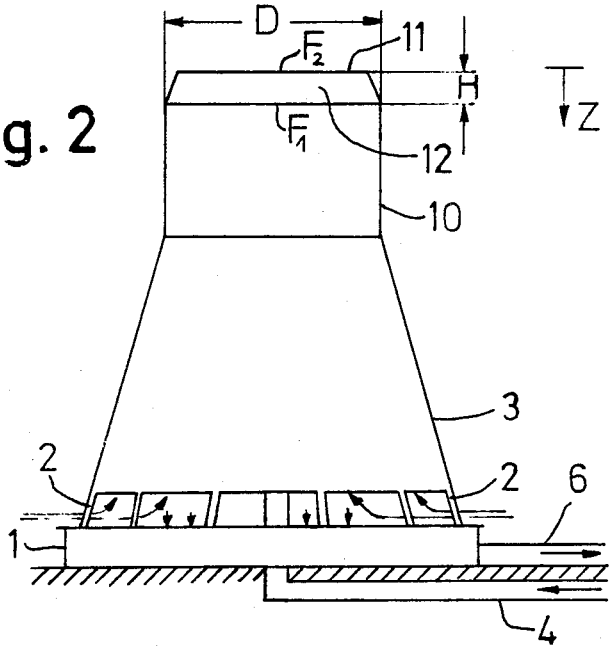
FIG. 2 is a side elevation of a cooling tower according to the present invention.

FIG. 2 shows a cooling tower which is constructed in the lower region in the same way as the conventional cooling tower according to FIG. 1. In the lower region, the wall 3 is likewise made conical, like the cooling tower according to FIG. 1. However, the conical region is followed by a cylindrical region 10, which latter is followed by a crown region 12 which is conically tapered towards the upper opening rim 11. The ratio H/D between the height H and the largest diameter D of this tapered region 12 amounts to approximately 1/6, and the ratio F2/F1 between the smallest cross-sectional area $F_2$, which at the same time represents the outlet cross-section of the cooling tower, and the largest cross-sectional area $F_1$ of the tapered region 12 amounts to 4/5 with an average diameter of the cooling tower of about 40 m. If the absolute velocity increases at substantially constant air flow in the cooling tower with an absolute diameter D, the ratio $F_2/F_1$ may be made greater in accordance with the findings of the inventors.

The crown region 12 joins the cylindrical region 10 at an oblique angle forming a circumferential ridge of "chine" which produces a desirable stiffening effect. The taper in the crown region results in the pressure gradients $\delta p/\delta z$ in the downward vertical direction z from the rim inside the cooling tower being greater than the pressure gradients on the outside of the tower. This overpressure prevents penetrations of cold air into the opening 11 when the air is still and when the wind velocities are low.

Figure 3:
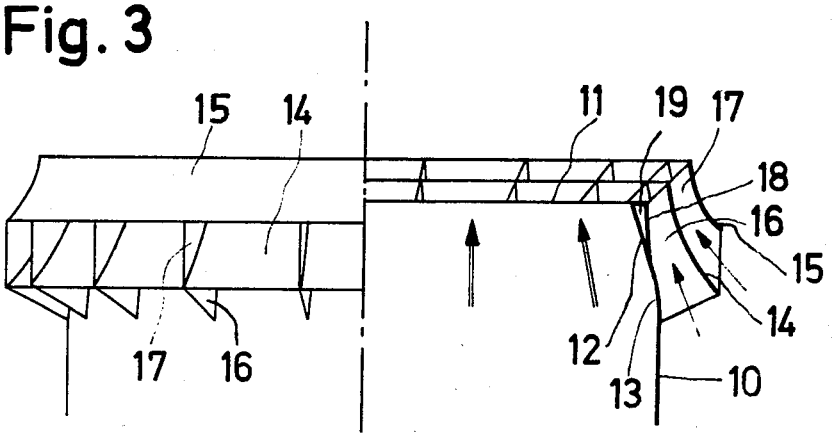
FIG. 3 is a side elevation, partly in section and to a larger scale, of the crown of a cooling tower designed according to the present invention.
Figure 4:
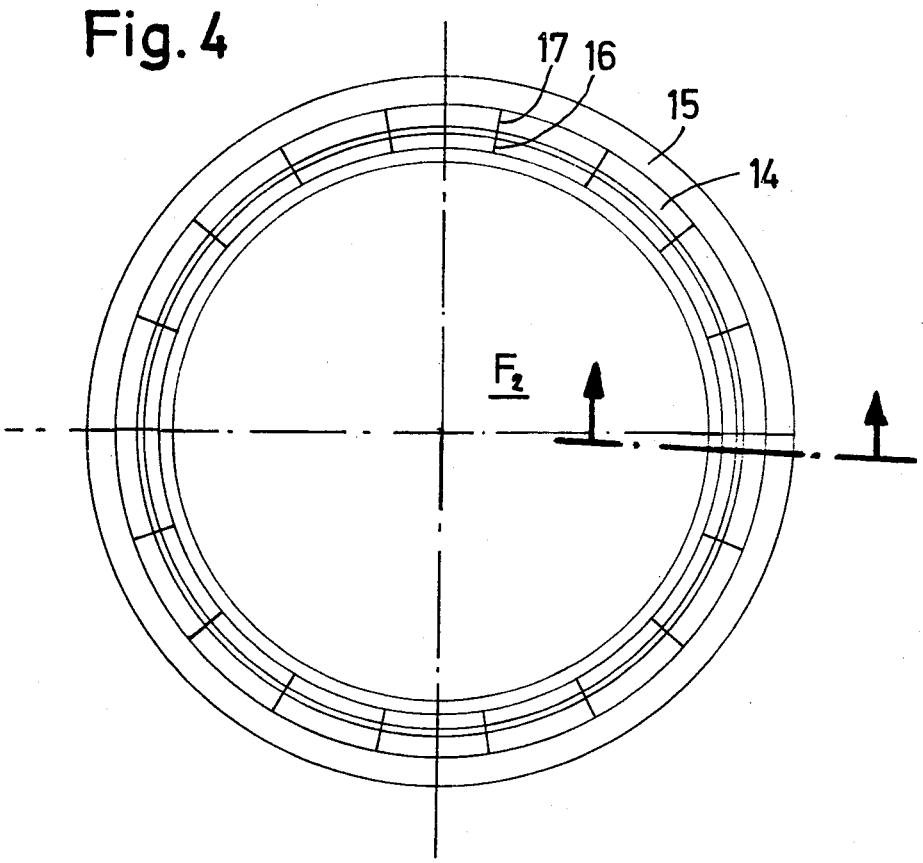
FIG. 4 is a top plan view of the cooling tower according to FIG. 3.

FIG. 3 represents only the crown of a cooling tower, shown in section in the right half, the tower being additionally provided with a wind-deflector. A portion of this right half shown in section is represented on a larger scale in FIG. 5. In the same way as in the cooling tower in FIG. 2, the crown in FIG. 3 comprises a tapered region 12 which follows and adjoins a cylindrical region 10 and of which the smallest cross-section is formed by the area $F_2$ enclosed by the opening rim 11. The cylindrical region 10 and tapered region 12 merge into one another by way of a rounded portion 13. As is the case throughout the cooling tower, it is important that surfaces merge smoothly into each other to avoid the creation of turbulent air flow in the tower.

Arranged on the outside of the tapered region 12 and coaxial with the cooling tower are two encased guide vanes 14, 15, with upwardly and inwardly extending flow ducts These ducts have a convex curvature towards their upper, almost vertical outlet ends and are separated by radial walls 16, 17. At their bottom inlets the longitudinal axes of the flow ducts have radially-inwardly directed horizontal components which are larger than at their outlets.

It is not the sloping wall of the tapered region 12 which is used as the inner boundary of the inner guide vane ring 14, but an annular wall 18 which is mounted thereon and which is provided for this purpose, the upper end portion of the said wall being directed substantially vertically. With a sheet metal construction as illustrated, a cavity 19 is thus formed between the tapered wall region 12 and the annular wall 18. This cavity construction, having two walls 12 and 18 supplemented by a ring 18' closing the upper end. This closed cavity is also desirable for static building reasons.

Figure 5:
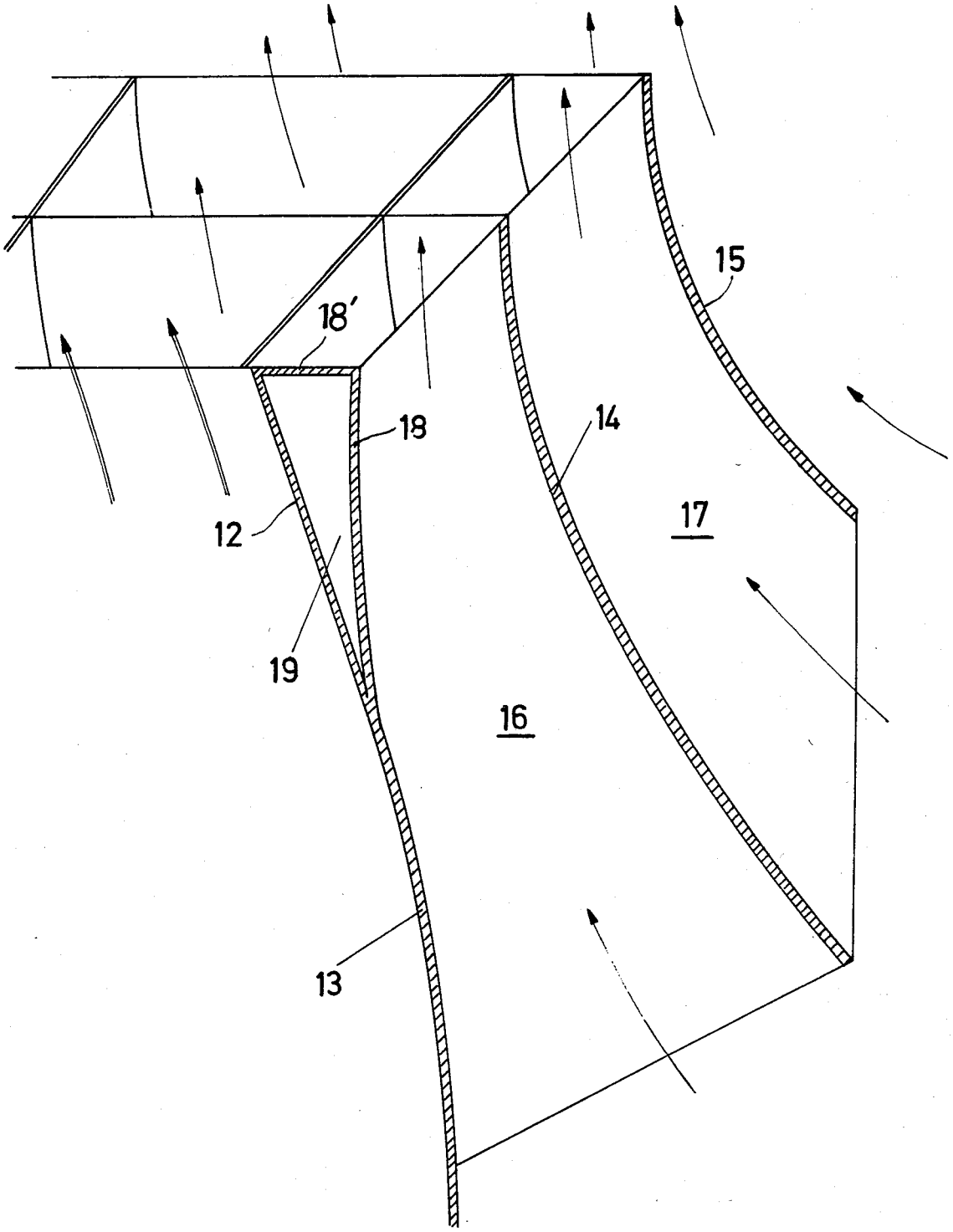
FIG. 5 is a partial section to an even larger scale through a detail of the cooling tower crown according to FIG. 3.

The guide vane rings deflect the side wind in an upward direction represented by the arrows having a single-line shaft in FIGS. 3 and 5, while the vapor discharges in the direction of the arrows having a two-line shaft. The establishment of a flow vortex extending horizontally in the outlet cross-section of the cooling tower is thus prevented by the guide vane rings at winds of high velocity.

A simple guide vane ring also already provides an improvement in conditions of high wind velocities. In another modified construction shown in FIG. 9, a wind-deflector is arranged facing only in the prevailing wind direction, on the outer circumference of the cooling tower crown. This wind-deflector can, for example, be operated by means of a conventional drive means (not shown) or by the wind itself, so as to be rotatable about an external ring gear 51 extending circumferentially around the crown.

Figure 9:
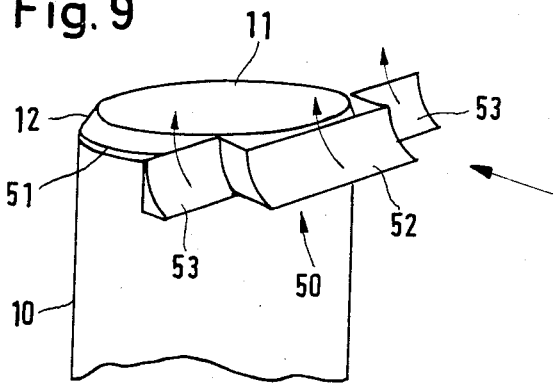
FIG. 9 is a perspective view of the upper part of a cooling tower with another form of wind-deflector.

Although the wind-deflector 50 in the constructional form shown in FIG. 9 is constructed in three parts, with a central deflector part 52 extending tangentially with respect to the rim 11 of the opening and two lateral deflector parts 53 extending parallel thereto in a chordal direction, the wind-deflector means can also comprise a single deflector part or consist of more than three deflector parts, and furthermore may be arranged in a fixed position if the wind, on average through the year, approaches the position at which the tower is erected mainly from one direction.

Figure 6:
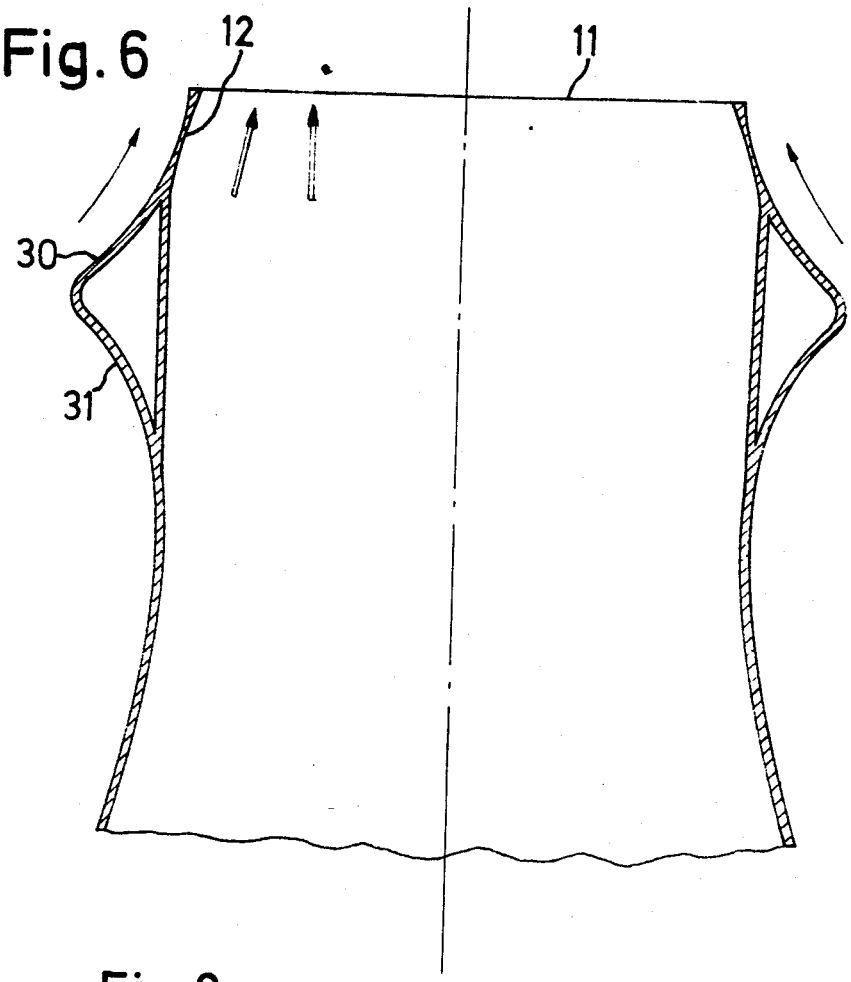
FIG. 6 is a section through the crown of a second embodiment of the cooling tower according to the present invention.

With the construction according to FIG. 6, there is provided a simple, annular wind-deflecting surface 30 instead of guide vanes. This wind-deflecting surface 30 extends nearly vertically at its upper part, so that it also imparts a vertical component to the lateral wind at the opening rim 11 of the cooling tower. This vertical component prevents the formation of a horizontal flow vortex when the side wind is strong. The wind-deflecting surface 30 is supported on its underside by a wall 31 merging smoothly into the wall of the cooling tower. This construction also greatly enhances the structural stability of the tower.

Figure 7:
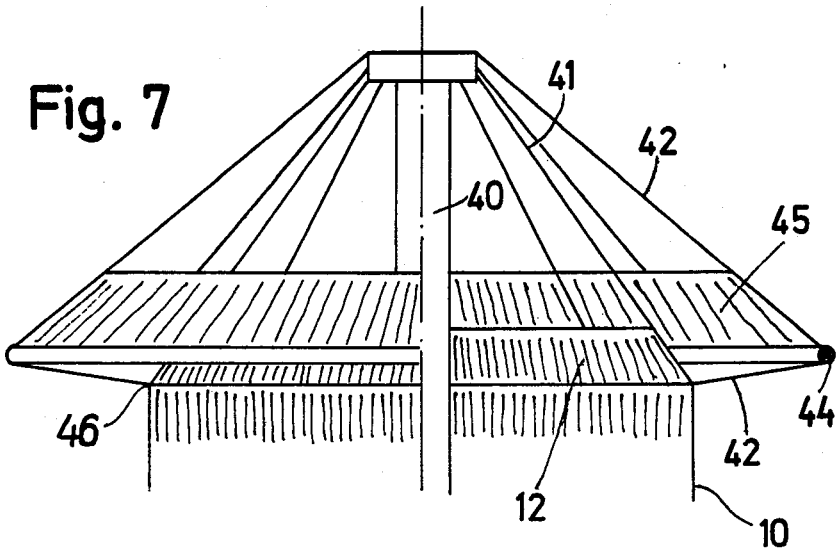
FIG. 7 is a partial elevation similar to FIG. 3, but partly in section, through another modified cooling tower crown according to the invention.
Figure 8:
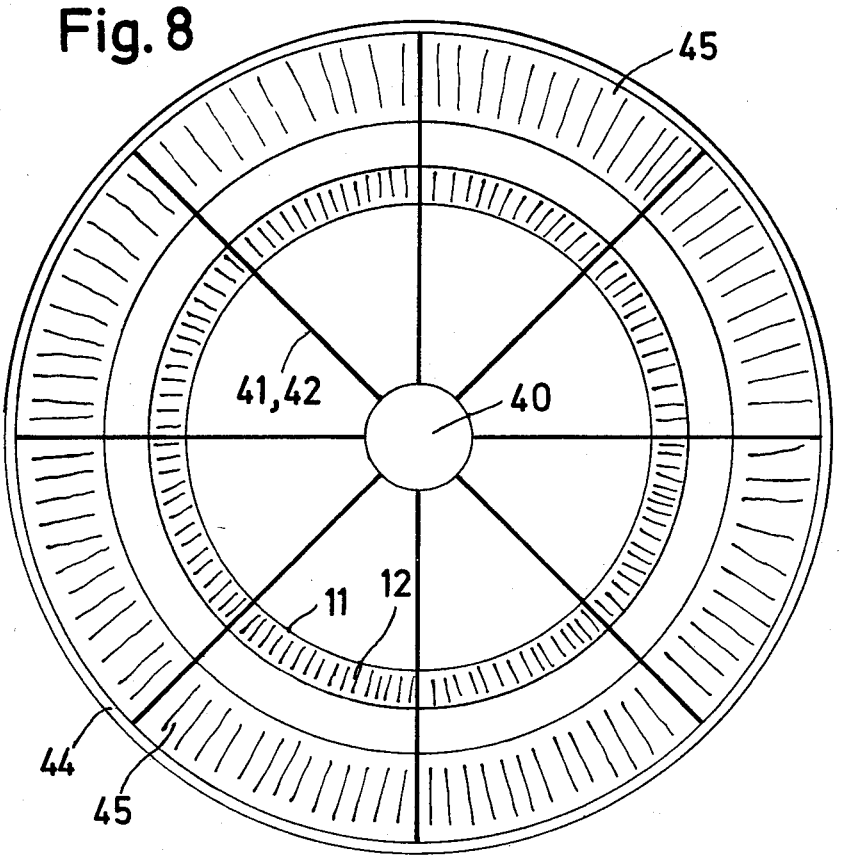
FIG. 8 is a top plan view of FIG. 7.

FIGS. 7 and 8 show a construction in which the cooling tower wall is suspended by means of cables 41 from a central, vertical mast 40. The cables 41 are fixed at the junction 46 between the tapered region 12 and the cylindrical wall 10 of the tower. Cables 42 having a relatively less steep inclination are tensioned between the top of the mast 43 and the circumference of the wall at 46 by means of a support ring 44. This support ring 44 is provided on the bottom edge of a conical wind-deflecting ring 45. With this construction, a conical annular wind-guiding duct is formed between the external wall of the tapered region 12 and the less steeply sloping internal wall of the wind-deflecting ring 45. If it should be desired for producing an even larger vertical component of the deflected side wind, a ring having a vertical outlet zone similar to the ring 18 in the construction illustrated in to FIGS. 3 and 5 can be fitted onto the external wall of the tapered crown region 12.

With the constructions according to FIGS. 3 and 9, any mixing of the side wind with the vapor beneath the outlet opening is avoided. This is important for an undisturbed functioning of the cooling tower.

The shell of the cooling tower can be erected by the usual known constructional methods, being made, for example, of concrete of sheet metal, or of a combined construction. In the latter case the shell will be made of concrete as far as the reduced or tapered region 12, this latter being made of sheet metal. In this arrangement, the tapered portion 12 will preferably be built up of a plurality of sheet metal ring elements, which are joined to one another along surface lines and are connected to one another, for example, by welding, bolting or riveting.

A concrete construction, which is frequently desired at the present time because of its economy, can be produced by the shuttering procedure which is known in the building industry, for example, using the conventional formwork method by which sections of the shell to be built are shuttered floor by floor, and the shuttering is filled with concrete, whereupon the concrete then sets. After the concrete of each section has set, the next section is then produced on the subjacent and already-set section in the same manner. The tapered crown region can also be produced in the same way.

By way of example, there are indicated below preferred specific dimensions for the tapered crown region 12 in respect of a cooling tower having the stated dimensions, it having been shown by the investigations of the inventors that such dimensions are able to reduce considerably or even to avoid completely cold air penetrations and the obstruction of the outlet area $F_2$ by side winds. For a cooling tower with a height of 100 meters and a diameter in the section $F_1$ (see FIG. 2) of $D=52$ meters, the axial length of the tapered crown portion should be 5 meters, the diameter of the outlet surface $F_2$ should be 46.5 meters, and the angle of slope of the tapered crown region 12 constructed conically with straight walls should be about 29° relative to the vertical.

We claim:

1. In a natural draught cooling tower having a collecting tank, a tower of circular cross-section converging inwardly over the lower portion thereof and being either cylindrical or diverging over the upper portion thereof, trickler plates within the tower and means for conveying the liquid to be cooled to the trickler plates, the improvement including means for preventing cold air break-ins in still air or winds of low velocity, said preventing means including a converging crown at the upper end of the tower, the ratio of the vertical height of said crown to the diameter of said crown at the lower end thereof being between about $\frac{1}{3}$ and about 1/12, the ratio of the vertical height of said crown to the total vertical height of the cooling tower being between about 1/33 and about 1/10, and the ratio of the cross-sectional area of the upper end of said crown to the cross-sectional area of the lower end of said crown being sufficient to produce a pressure gradient inside said crown immediately adjacent the wall thereof equal to or greater than the pressure gradient outside said crown immediately adjacent the wall thereof.

2. In a natural draught cooling tower according to claim 1 wherein the vertical height of the tower is at least 100 meters;

wherein the ratio of the vertical height of said crown to the diameter of said crown at the lower end thereof is approximately 1/7;

wherein the ratio of the vertical height of said crown to the total vertical height of the cooling tower is about 1/20; and wherein the ratio of the cross-sectional area of said crown at the upper end thereof to the cross-sectional area of said crown at the lower end thereof is about 4/5.

3. The cooling tower of claim 2 wherein said crown includes means external of the tower and operative at winds in excess of about 10 m/s for upwardly deflecting lateral winds to a substantially vertical direction to thereby inhibit the formation of a vortex extending over a portion of the top of the cooling tower on the windward side thereof.

4. A natural draught cooling tower according to claim 1 wherein the height of said tower is about 100 meters;

wherein said crown is a frustoconical shape with walls inclined about 29 degress to the vertical;

wherein the diameter of said crown at the lower end thereof is about 52 meters; and wherein the diameter of said crown at the upper end thereof is about 46.5 meters.

5. The cooling tower of claim 1 wherein said crown includes deflector means external of the tower and operative at winds in excess of about 10 m/s for upwardly deflecting lateral winds to a substantially vertical direction to thereby inhibit the formation of a vortex extending over a portion of the top of the cooling tower on the windward side thereof.

6. A natural draught cooling tower according to claim 5 wherein said deflector means includes a plurality of sections radially disposed about the upper end of the tower, each of said sections including two compartments, one radially overlying the other, the radially outer wall of the radially outer compartment, the radially inner wall of the radially outer compartment and the radially inner wall of the radially inner compartment serving as wind deflectors.

7. A cooling tower according to claim 1 including a central mast and means for suspending said tower by cables from said central mast; and wind deflector means comprising a conical wind deflecting ring supported from said mast by cables, said wind deflecting ring having an upright deflector surface, the slope of said deflector surface being lower at the lower end thereof than the slope at the upper end thereof.

8. A natural draught cooling tower according to claim 1 wherein the vertical height of the tower is at least 100 meters; and wherein the ratio of the vertical height of said crown to the diameter of said crown at the lower end thereof is approximately 1/7.

9. A natural draught cooling tower according to claim 1 wherein the vertical height of the tower is at least 100 meters; and wherein the ratio of the vertical height of said crown to the total vertical height of the cooling tower is about 1/20.

10. A natural draught cooling tower according to claim 1 wherein the vertical height of the tower is at least 100 meters; and wherein the ratio of the cross-sectional area of said crown at the upper end thereof to the cross-sectional area of said crown at the lower end thereof is about 4/5.

11. A natural draught cooling tower according to claim 1 wherein the ratio of the vertical height of said crown to the diameter of said crown at the lower end thereof is approximately 1/7;

wherein the ratio of the vertical height of said crown to the total vertical height of the cooling tower is about 1/20; and wherein the ratio of the cross-sectional area of said crown at the upper end thereof to the cross-sectional area of said crown at the lower end thereof is about 4/5.

12. A natural draught cooling tower according to claim 1 wherein the height of said tower is about 100 meters; and wherein said crown is a frustoconical shape with walls inclined about 29 degrees to the vertical.

13. A natural draught cooling tower according to claim 1 wherein the height of said tower is about 100 meters;

wherein the diameter of said crown at the lower end thereof is about 52 meters; and wherein the height of said crown at the upper end thereof is about 4.5 meters.

14. A natural draught cooling tower according to claim 1 wherein the height of said tower is about 100 meters;

wherein said crown is a frustoconical shape.

15. A natural draught cooling tower according to claim 1 wherein the height of said tower is about 100 meters;

wherein the diameter of said crown at the lower end thereof is about 52 meters; and wherein the diameter of said crown at the upper end thereof is about 46 meters.

16. In a natural draught cooling tower having a collecting tank, a tower of circular cross-section converging inwardly over the lower portion thereof and being either cylindrical or diverging over the upper portion thereof, trickler plates within the tower and means for conveying the liquid to be cooled to the trickler plates, the improvement including means for preventing cold air break-ins in still air or winds of low velocity, said preventing means including a converging crown at the upper end of the tower, the ratio of the vertical height of said crown to the diameter of said crown at the lower end thereof being between about $\frac{1}{3}$ and about 1/12, the ratio of the vertical height of said crown to the total vertical height of the cooling tower being between about 1/33 and about 1/10, the ratio of the cross-sectional area of the upper end of said crown to the cross-sectional area of the lower end of said crown being sufficient to produce a pressure gradient inside said crown immediately adjacent the wall thereof equal to or greater than the pressure gradient outside said crown immediately adjacent the wall thereof, said crown including deflector means external of the tower and operative at winds in excess of about 10 m/s for upwardly deflecting lateral winds to a substantially vertical direction to thereby inhibit the formation of a vortex extending over a portion of the top of the cooling tower on the windward side thereof, said reflector means being generally rectangular; and including means for selectively positioning said deflector means around the periphery of the tower so that said deflector means may be faced into the wind.

17. In a natural draught cooling tower having a collecting tank, a tower of circular cross-section converging inwardly over the lower portion thereof and being either cylindrical or diverging over the upper portion thereof, trickler plates within the tower and means for conveying the liquid to be cooled to the trickler plates, the improvement including means for preventing cold air break-ins in still air or winds of low velocity, said preventing means including a converging crown at the upper end of the tower, the ratio of the vertical height of said crown to the diameter of said crown at the lower end thereof being between about $\frac{1}{3}$ and about 1/12, the ratio of the vertical height of said crown to the total vertical height of the cooling tower being between about 1/33 and about 1/10, the ratio of the cross-sectional area of the upper end of said crown to the cross-sectional area of the lower end of said crown being sufficient to produce a pressure gradient inside said crown immediately adjacent the wall thereof equal to or greater than the pressure gradient outside said crown immediately adjacent the wall thereof, a central mast and means for suspending said tower by cables from said central mast; and wind deflector means comprising a conical wind deflecting ring supported from said mast by cables, said wind deflecting ring having an upright deflector surface, the slope of said deflector surface being lower at the lower end thereof than the slope at the upper end thereof, the cables supporting said conical deflecting ring being tensioned between said mast and said tower by means of a support ring at the base of said conical deflecting ring.

18. A natural draught cooling tower of circular cross-section having a crown, the ratio of the vertical height of said crown to the diameter thereof at the lower end thereof being between about $\frac{1}{3}$ and 1/12, the ratio of the vertical height of said crown to the total height of the cooling tower being between about 1/33 and 1/10, said crown having a diverging outer wall and a converging inner wall radially separated from each other at the upper extremity thereof, the ratio of the cross-sectional area of the upper end of said converging inner wall to the cross-sectional area of the lower end of said converging inner wall creating at the upper end of the tower in still air or air of low velocity a pressure gradient immediately adjacent said converging inner wall inside the tower greater than the pressure gradient immediately adjacent said diverging outer wall external of the cooling tower; and said diverging outer wall serving as a deflector in winds greater than about 10 m/s to impair the creation of a vortex extending over the tower.

19. In a natural draught cooling tower of circular cross-section having a crown region including a crown having an opening defined by the upper rim of said crown for discharging vapor, the improvement including means for preventing cold air break-ins at still air or winds of low velocity, said preventing means including said crown to converge in direction to the upper end of the tower, the ratio of the vertical height of the crown to that of the tower being between about 1/33 and about 1/10, the ratio of the vertical height of said crown to the diameter of said crown at the lower end thereof being between about $\frac{1}{3}$ and about 1/12, and the ratio of the cross-sectional area of the upper end of said crown to the cross-sectional area of the lower end of said crown being sufficient to produce a pressure gradient inside said crown immediately adjacent the wall thereof equal to or greater than the pressure gradient outside said crown immediately adjacent the wall thereof.

20. A natural draught cooling tower according to claim 19 wherein the vertical height of the tower is at least 100 meters; and wherein the ratio of the vertical height of said crown to the diameter of said crown at the lower end thereof is approximately 1/7.

21. A natural draught cooling tower according to claim 19 wherein the vertical height of the tower is at least 100 meters; and wherein the ratio of the vertical height of said crown to the total vertical height of the cooling tower is about 1/20.

22. A natural draught cooling tower according to claim 22 wherein the vertical height of the tower is at least 100 meters; and wherein the ratio of the cross-sectional area of said crown at the upper end thereof to the cross-sectional area of said crown at the lower end thereof is about 4/5.

23. A natural draught cooling tower according to claim 19 wherein the ratio of the vertical height of said crown to the diameter of said crown at the lower end thereof is approximately 1/7;

wherein the ratio of the vertical height of said crown to the total vertical height of the cooling tower is about 1/20; and wherein the ratio of the cross-sectional area of said crown at the upper end thereof to the cross-sectional area of said crown at the lower end thereof is about 4/5.

24. A natural draught cooling tower according to claim 19 wherein the height of said tower is about 100 meters; and wherein said crown is a frustoconical shape with walls inclined about 29 degrees to the vertical.

25. A natural draught cooling tower according to claim 19 wherein the height of said tower is about 100 meters;

wherein the diameter of said crown at the lower end thereof is about 52 meters; and wherein the height of said crown at the upper end thereof is about 4.5 meters.

26. A natural draught cooling tower according to claim 19 wherein the height of said tower is about 100 meters;

wherein said crown is a frustoconical shape.

27. A natural draught cooling tower according to claim 19 wherein the height of said tower is about 100 meters;

wherein the diameter of said crown at the lower end thereof is about 52 meters; and wherein the diameter of said crown at the upper end thereof is about 46 meters.

* * * * *